US006310309B1

(12) United States Patent
Ager et al.

(10) Patent No.: US 6,310,309 B1
(45) **Date of Patent: *Oct. 30, 2001**

(54) METHODS OF ANALYSIS/SEPARATION

(75) Inventors: Colin D. Ager; Andrew N. Dames, both of Cambridge; Duncan R. Purvis, Royston; Nicholas A. Safford, Cambridge, all of (GB)

(73) Assignee: Scientific Generics Limited, Cambridge (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/266,806

(22) Filed: Mar. 12, 1999

Related U.S. Application Data

(63) Continuation of application No. PCT/GB97/02484, filed on Sep. 10, 1997.

(30) Foreign Application Priority Data

Sep. 12, 1996 (GB) ..... 9619093

(51) Int. Cl.[7] ..... B03C 7/00
(52) U.S. Cl. ..... 209/127.1; 209/128; 209/232
(58) Field of Search ..... 209/127.1, 128, 209/129, 212, 232, 213, 214

(56) References Cited

U.S. PATENT DOCUMENTS 5,169,006 * 12/1992 Stelzer ..... 209/232 X
5,454,472 10/1995 Benecke et al. ..... 209/127.1
5,465,849 * 11/1995 Wada et al. ..... 209/232 X

FOREIGN PATENT DOCUMENTS

2130923 * 6/1984 (GB) ..... 209/129
52-105371 9/1977 (JP) .
92/07657 5/1992 (WO) .
94/16821 8/1994 (WO) .
96/31282 10/1996 (WO) .

OTHER PUBLICATIONS

Fuhr, et al., "Asynchronous Traveling–wave Induced Linear Motion of Living Cells", Studia Biophysica, vol. 140, No. 2, 1991, pp. 79–102.

Price, et al., "Applications of a New Optical Technique for Measuring the Dielectrophoretic Behaviour of Micro–Organisms", Biochimica et Biophysica Acta 964 (1988) pp. 221–230.

Masuda, et al., "Separation of Small Particles Suspended in Liquid by Nonuniform Traveling Field", IEEE Transactions on Industry Applications, vol. LA–23, No. 3, May/Jun. 1987.

Hagedorn, et al., "Traveling–wave Dielectrophoresis of Microparticles", Electrophoresis, 1992, 13, pp. 49–54.

Huang, et al., "Electrokinetic Behaviour of Colloidal Particles in Travelling Electric Fields: Studies using Yeast Cells", J. Phys. D: Appl. Phys. 26 (1993) pp. 1528–1535.

Washizu, et al., "Handling Biological Cells Using a Fluid Integrated Circuit", IEEE Transactions on Industry Applications, 26, No. 2, Mar./Apr. 1990.

Washizu, "Electrostatic Manipulation of Biological Objects", Journal of Electrostatics, 25 (1990) pp. 109–123.

* cited by examiner

*Primary Examiner*—Tuan N. Nguyen
(74) *Attorney, Agent, or Firm*—Pillsbury Winthrop LLP

(57) ABSTRACT

Particles are separated according to their dielectrophoretic characteristics and electrorotation characteristics by the use of a travelling wave separation in which they flow from a departure point at an inlet (18) towards at least two destinations at outlets (16, 20) and are deflected toward one or other outlet according to their characteristics by a travelling wave field set up on an array of electrodes, each electrode running generally in the direction of flow.

10 Claims, 5 Drawing Sheets

METHODS OF ANALYSIS/SEPARATION

This is a Continuation of: International Appln. No. PCT/GB97/02484 filed Sep. 10, 1997 which designated the U.S.

BACKGROUND OF THE INVENTION

1. Field of the Invention

The present invention relates to methods for separating particles based upon the migration of particles in response to an electric field.

2. Description of Related Art

By way of background, particles can be manipulated by subjecting them to travelling electric fields. Such travelling fields are produced by applying appropriate voltages to microelectrode arrays of suitable design. The microelectrodes may have the geometrical form of parallel bars, which may be interrupted by spaces to form channels and may be fabricated using standard metal sputtering and photolithographic techniques as described by Price, Burt and Pethig, *Biochemica et Biophysica*, Vol.964, pp.221–230. Travelling electric fields are generated by applying voltages of suitable frequency and phases to the electrodes as described in "Separation of small particles suspended in liquid by non-uniform travelling field ", by Masuda, Washizu and Iwadare, IEEE Transactions on Industry Applications, Vol.IA-23, pp.474–480. Masuda and his coworkers describe how a series of parallel electrodes (with no channels) supporting a travelling electric field can, in principle, be used to separate particles according to their electrical charge and size (weight) . Masuda et al have not however described a practical demonstration of such a particle separation method.

In a paper entitled "Travelling-wave dielectrophoresis of microparticles" by Hagedorn, Fuhr, Muller and Gimsa (Electrophoresis, Vol.13, pp.49–54) a method is shown for moving dielectric particles, like living cells and artificial objects of microscopic dimensions, over micro-electrode structures and in channels bounded by the electrodes. The travelling field was generated by applying voltages of the same frequency to each electrode, with a 90° phase shift between neighbouring electrodes.

In "Electrokinetic behaviour of colloidal particles in travelling electric fields: Studies using Yeast cells" by Y Huang, X-B Wang and R Pethig J. Phys. D. Appl. Phys. 26 1993 1528–1535, an analysis supported by experiment is made of the "travelling-wave dielectrophoresis" (TWD) effect described by Hagedorn et al (paper cited above). The phenomenological equation $$\mu = -\frac{2\pi\epsilon_m r^2}{3\lambda\eta} A^2(O)\mathrm{Im}[f(\epsilon_p^*, \epsilon_m^*)]$$

is developed by Huang et al, to show that the TWD velocity is a function of the square of the particle radius (r), the square of the electric field strength (A(0)), the periodic length of the travelling field (λ), medium viscosity (η) and the imaginary part of the Clausius-Mossotti factor $f(\epsilon_p^*, \epsilon_m^*)$ defining the dielectric properties of the particle and the suspending medium in terms of their respective complex permittivities $\epsilon_p^*$ and $\epsilon_m^*$ This equation provides, for the first time, a practical guide for the design of travelling wave electrode systems for the manipulation and separation of particles.

Although the phenomenon in question is usually termed "travelling wave dielectrophoresis", this is something of a misnomer as the force which acts on the particles to produce translational movement is not the dielectrophoresis force but rather that which acts in electrorotation. This force is related to the imaginary component of the polarisability of the particle within its surrounding medium. However, as is discussed in more detail below, particle migration only occurs for travelling wave frequencies which produce negative dielectrophoretic forces on the particle. (Dielectrophoretic forces are related to the real component of the polarisability of the particle within its surrounding medium.) These forces are responsible for lifting the particle away from the electrodes. We accordingly prefer to refer to the phenomenon called previously "travelling wave dielectrophoresis" by the name "travelling wave field migration" (TWFM). As disclosed in WO94/16821 we have established that to obtain TWFM, two separate criteria have to be met. First, a frequency must be selected at which the dielectrophoresis force acting on the particles is negative, i.e. such as to repel the particles from the electrodes. This, we have found requires the real component of the dipole moment induced in the particles to be negative.

Second, the frequency selected has to be such that the imaginary component of the dipole moment induced in the particles is non-zero (whether positive or negative) to produce a force displacing the particles along the array of electrodes.

In all of these previous proposals where particles are separated on the basis of their TWFM behaviour, the particles are caused to migrate at different rates and those migrating faster are separated from those migrating more slowly or not at all. The sample volumes which can be handled are extremely small, being determined by the size of the apparatus. There is no flow of sample material through the separation apparatus.

DE 4127405 and family number U.S. Pat. No. 5,454,472 disclose the use of a travelling wave electrode array of parallel electrodes to draw particles along a path running transversely to the electrodes. Simultaneously, a field applied is from side to side of the electrode array to draw particles into one of two outlet channels (FIG. 2). The separation of the particles is therefore not due to differing travelling wave field migration properties but differing behaviour under the stationary electrophoresis field. The travelling wave field is used merely to produce movement of the particles through the apparatus.

In "Electrostatic Manipulation of Biological Objects" (J. of Electrostatics 25 (1990) 109–123) Washiza describes a cell separator having an inlet and two outlets between which passes a flow of liquid containing cells. Each cell is held by dielectrophoretic attraction by a 1 $mH_2$ field and is investigated by means which is not described. Based upon the result of the investigation the cell is released by turning off the field and is either passed to a first outlet by the flow or is deflected to the second outlet by reapplication of the field to a second pair of electrodes. This does not involve separating cells according to their differing TWFM characteristics.

SUMMARY OF THE INVENTION

In accordance with the present invention in contrast to the teaching of WO94/16821, a flow of particles through the apparatus in a direction transverse to the direction of TWFM induced separation between the particles is used to enable larger volumes of sample to be processed.

Accordingly, in a first aspect, the present invention provides a method of separation of particles comprising passing a mixture of particles to be separated through a separator having departure point (e.g. an inlet) for particles to be separated and at least two designations, (optionally taking the form of two outlets) for separated particles, in which the particles are caused to move along a path from said departure point to said destinations and are subjected to a travelling wave field producing particle movement transverse to said path so as to separate said particles such that differing particle populations reach respective ones of said destinations.

The method may be operated with multiple separation stages arranged in parallel or in series. Thus there is provided a method as described above wherein said separator comprises multiple separation stages operating in parallel, each stage having a departure point for particles to be separated and at least two destinations for separated particles, in each of which stages the particles are caused to move along a path from said departure point to said destinations and are subjected to a travelling wave field producing particle movement transverse to said path so as to separate said particles such that differing particle populations reach respective ones of said destinations.

There is also provided a method as described comprising passing a mixture of particles to be separated through a said separator providing multiple separation stages each stage having a departure point for particles to be separated and at least two destinations for separated particles, in each of which stages the particles are caused to move along a path from said departure point to said destinations and are subjected to a travelling wave field producing particle movement transverse to said path so as to separate said particles such that differing particle populations reach respective ones of said destinations, with particles of a selected population being fed from the respective destination of each stage to the departure point of the next stage.

Said particles are preferably microparticles. They may be biomolecules such as oligonucleotides, other DNA or RNA molecules, proteins, or peptides. They may be cells such as bacteria, oocytes, mammalian cells or other animal cells, plan cells, yeast cells or organisms such as viruses or prions. They may be cell components such as chromosomes undergoing meiosis and mitosis.

The particles of a selected population may be recycled to the departure point of the separator so that they will pass again through the separation process.

The invention further provides apparatus for use in separating particles comprising a departure point and at least two destinations, means defining a path for particle movement between said departure point and said destinations, an array of electrodes spaced from one another and each extending generally in the direction of said path, and means for applying a travelling electrical field to said electrode array to produce travelling wave field migration of selected particles in said path in a direction transverse to said path such that said selected particles are preferentially directed to a respective one of said destinations.

Such apparatus may comprise multiple stages, each stage comprising a departure point and at least two destinations, means defining a path for particle movement between said departure point and said destinations, an array of electrodes spaced from one another and each extending generally in the direction of said path, and means for applying a travelling electrical field to said electrode array to produce travelling wave field migration of selected particles in said path in a direction transverse to said path such that said selected particles are preferentially directed to a respective one of said destinations, with said destination for the selected particles of each stage or the or an other of said destinations of each stage being connected to the departure point of the next said stage.

Alternatively or additionally such apparatus may comprise multiple stages arranged to operate in parallel, each stage comprising a departure point and at least two destinations, means defining a path for particle movement between said departure point and said destinations in each stage, an array of electrodes spaced from one another and each extending generally in the direction of said path, and means for applying a travelling electrical field to said electrode array to produce travelling wave field migration of selected particles in said path in a direction transverse to said path such that said selected particles are preferentially directed to a respective one of said destinations of each stage.

The separation processes described herein may form part of or serve as an assay procedure, for instance by detecting the presence of certain particles by success in separating them, optionally made quantitative by counting the particles separated or otherwise assessing their numbers.

To assist in the separation one may treat a population of said particles to form altered particles, which altered particles have TWFM properties distinct from those of the original particles, and produce translational movement of said altered particles by TWFM using conditions under which the movement of the altered particles is different from that which would be obtained using the original particles under identical conditions, so as to assist in the desired separation.

The particles may be of a size to be visible using a light microscope (microscopic particles) or may be smaller (submicroscopic particles) and may be detected using labels such as luminescent, fluorescent and electromagnetic radiation absorbent labels.

The nature of the treatment used to convert the original particles into altered particles can vary widely according to the nature of the particles. The treatment may involve forming complexes between the particles and a ligand. In some cases, the complex may involve a linking moiety connecting the particle and the ligand. The complex may further include a label connected to said ligand, optionally via a second linking moiety. The complex may involve numerous ligands bound to the particle.

The choice of linking moiety will obviously depend on the nature of the particle and the ligand. For instance if one wishes to capture a nucleic acid species (the ligand) on a plastics micro-sphere (the particle), the linking moiety will normally be chosen to be a nucleic acid or nucleic acid analogue oligomer having a sequence complementary to that of the ligand or a part thereof.

The linking moiety may be bound first to the particle and may then be a species having an affinity for the ligand. Preferably, said affinity for the ligand is a selective affinity such that the formation of the complex between the particle and the ligand is selective and provides at least a degree of identification of the ligand. Preferably, said affinity is highly specific and accordingly the said linking moiety bound to the particle which provides the selective affinity for the ligand may be an antibody or an antibody fragment having antibody activity, an antigen, a nucleic acid probe or a nucleic acid analogue probe having selective affinity for complementary nucleic acid sequences, or avidin or an avidin-like molecule such as streptavidin.

Antibodies and antibody fragments having antibody reactivity are particularly preferred. There are known techniques suitable for coating antibodies on to the surface of particles such as plastics micro-beads which are well known to those skilled in the art. Antibody coated particles are capable of recognising and binding corresponding antigens which may be presented on micro-organism cells or some other ligand.

Methods are also known for binding oligonucleic acid probes to such micro-beads. Suitable techniques are by way of example described in WO93/01499. Where the linking moiety is a nucleic acid probe or a nucleic acid analogue probe, the resulting particle will of course be suitable for recognising and binding complementary nucleic acid sequences.

The ligand may be chosen to increase the visibility of the particle or otherwise improve its detectability as well as to alter its TWFM characteristics. For instance antibodies bearing fluorophores or chromophores may be bound to the particle so that the complex so formed can be distinguished from the starting particle by TWFM and detected by fluorescence or colour.

Generally, the techniques which may be used in connection with such altered particles are described in detail in WO94/16821.

The methods according to the invention may be employed in a wide variety of analytical applications including separation and analysis of samples containing cells for example, bacterial, mammalian, yeast, and insect cells or virus particles, and, biological macromolecules. Current methods of separating cells, for example flow cell cytometry, require expensive instrumentation, skilled operators and significant laboratory resources. The techniques also have limitations when there are many different cell populations to be separated and when the cells of interest represent less than a few percent of the total. For separation and analysis of modified biological molecules, or complexes between biological macromolecules, employed techniques include electrophoresis and chromatographic separation using gel-filtration or affinity chromatography. Although these, in some cases, provide adequate separation, for many applications they can be time consuming and have limited resolution. In addition, use of these methods can affect the equilibrium between biological complexes. For example, gel-filtration results in a significant dilution of the sample. Generally, these methods are limited as regards the sample volume they can cope with.

Methods described hereafter according to the present invention allow some or all of these drawbacks to be addressed.

Where in an analytical method according to the invention a complex between the particle and a ligand is produced, the ligand need not itself be the species to establish the presence, nature or quantity of which is the ultimate purpose of the analysis. Thus, the ligand may be a reagent in the analysis and the species of interest in the analysis may be another component of the complex, e.g. the linking moiety or the particle itself. Where a particle is altered by treatment with a reagent, it may be the particle or the reagent which is essentially to be studied.

The process of TWFM described previously has been carried out using an array of linear, parallel electrodes subjected to phased electric fields normally such that every fourth electrode along the TWFM path is in phase. This periodicity defines the effective wave length of the travelling wave field produced. We have established that this wave length is optimally about ten times the average diameter of the particle to be moved under TWFM, eg from 5 to 20 times or more preferably 8 to 12 times said average diameter. For particles which are not roughly circular, it is the length in the direction transverse to TWFM movement which is of significance.

The electrodes may be formed, depending on the dimensions required, using any of the standard techniques for patterning and manufacturing microscopic structures. For example the electrodes can be produced by:

- screen printing;
- deposition of electrode material (eg by electroplating or sputter deposition) followed by one of the following patterning techniques:
  - direct writing using an electron beam followed by etching (eg wet chemical etching, dry plasma etching or focused ion beam etching);
  - writing by exposure through a photolithographically generated mask followed by etching—the mask may be generated for example by visible, ultra violet, X-ray or electron beam lithography;
  - excimer laser ablation;
- patterning followed by deposition of the electrode material (as in the X-ray LIGA process).

BRIEF DESCRIPTION OF THE INVENTION

The invention will be further described and illustrated by the following description of apparatus and methodology with reference to the accompanying drawings in which.

DETAILED DESCRIPTION OF THE INVENTION

Figure 1:
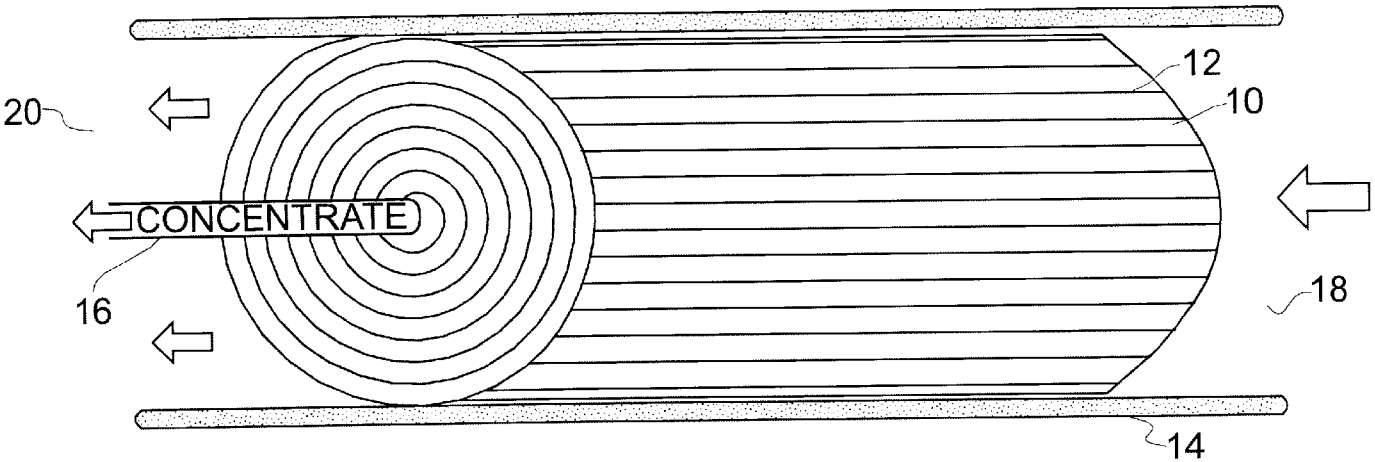
FIG. 1 shows a first embodiment of apparatus according to the invention.

As shown in FIG. 1, a first embodiment of apparatus according to the invention comprises a band of flexible substrate 10 of insulating material such as plastics sheet having printed thereon or otherwise formed thereon finely spaced conductive electrodes 12 extending parallel to one another across the width of the substrate 10. The substrate 10 is rolled into a cylinder and is placed in a cylindrical housing 14. An outlet tube 16 is provided at the outlet end of the apparatus communicating with the central turns of the rolled substrate 10.

Figure 2:
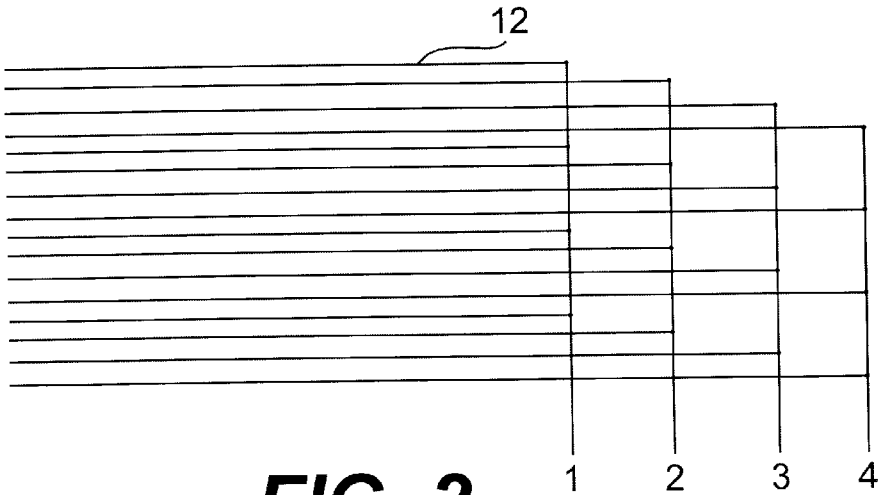
FIG. 2 is a schematic view of the electrical connection of the apparatus of FIG. 1.

As shown in FIG. 2, the electrodes of the apparatus are wired such that every fourth electrode is connected in common to one of four voltage buses (1, 2, 3, 4). A sinusoidal voltage is applied to each of these which is 90° out of phase with respect to the next one and the previous one, i.e. 0°, 90°, 180° and 270°.

A liquid containing particles to be separated may be introduced at the end 18 of the housing 14 and can percolate through the spaces between turns of the roll of the substrate 10 to emerge at the outlet end 20 of the housing 14. The application of a travelling wave electrical field to the electrodes 12 in the manner described in WO94/16821 via the connections shown in FIG. 2 can be adjusted to cause travelling wave field migration of selected particles in the liquid across the array of electrodes 12 toward the centre of the apparatus. Depending upon the particles concerned, it may be possible to arrange for the travelling wave field migration conditions to be chosen such that a separate population of particles in the mixture migrates in the opposite direction towards the outside of the apparatus. Alternatively, such a second population of different particles may be unaffected by the travelling wave field.

By this means, chosen particles are caused to concentrate in the centre of the apparatus and to flow out through the tube 16. The outflow from tube 16 may of course be introduced as the inlet fluid for a subsequent similar apparatus acting as a second stage and this process may be repeated indefinitely to obtain adequately separated particles. Of course, the particles concentrated to the centre of the apparatus may either be those of interest or may be those to be eliminated from the sample, leaving those of interest behind in the main flow.

Optionally, the outflow from the outlet 20 of the apparatus may be recycled to the inlet 18 to provide a further opportunity for particles in the desired population to migrate into the centre and to find their way into the outlet tube 16.

Figure 3:
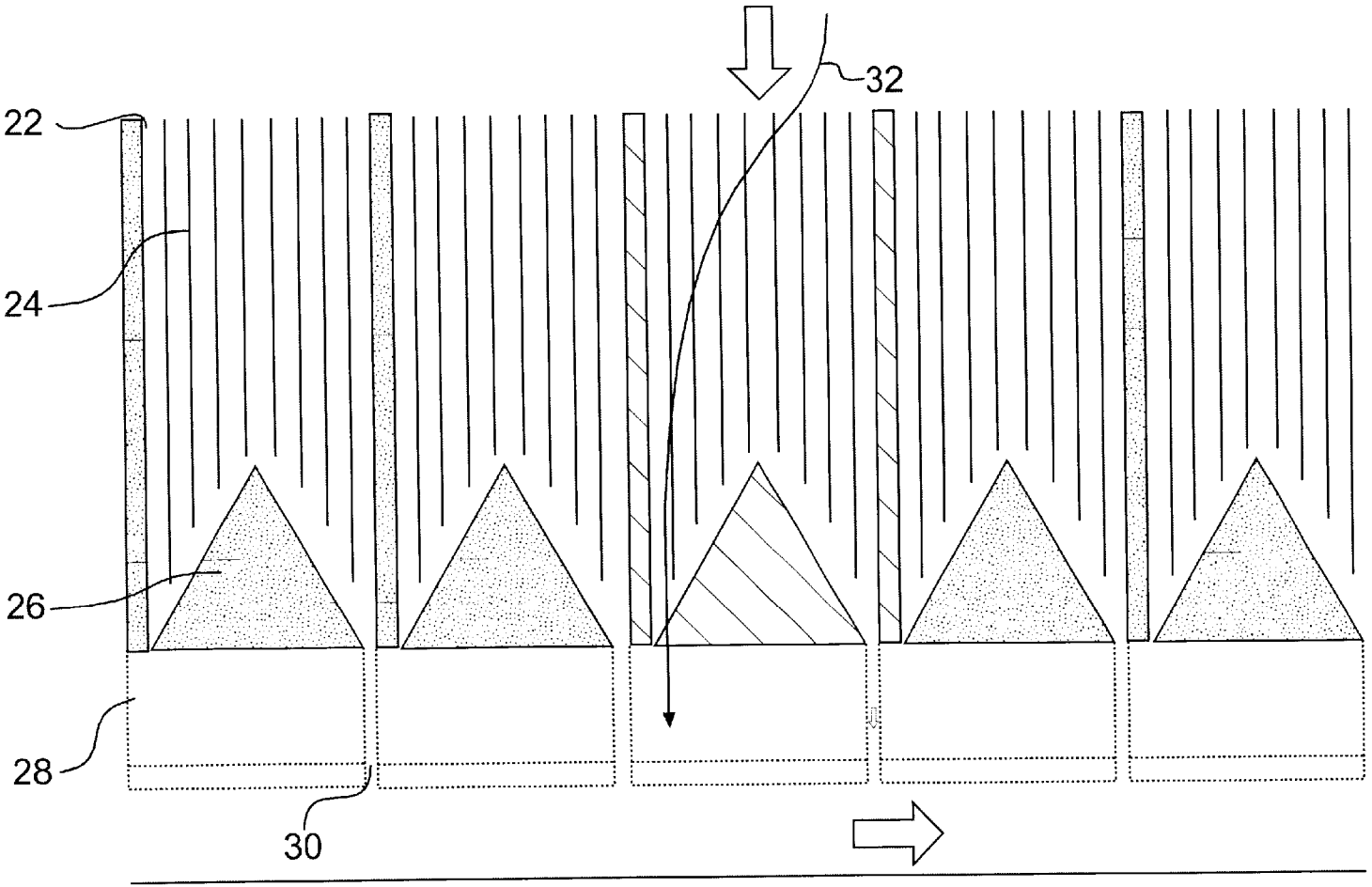
FIG. 3 shows a second embodiment according to the invention in which multiple separation stages are arranged in parallel.

The embodiment shown in FIG. 3 comprises a bank of linear separators each of which comprises a flat substrate 22 bearing an array of electrodes 24 extending parallel to one another along the length of the substrate 22 so as to form a ladder of electrodes across the width of the substrate 22 within each separator stage. A flow diverter 26 serves to separate a first outlet passage 28 from a second outlet passage 30 such that the outlet passage 28 collects liquid flowing down the left-hand side of the separator stage and the outlet 30 collects liquid flowing down the right-hand side.

If a liquid containing two populations of particles is introduced at the top of the stage on the substrate 22 and is flowed down the substrate over the electrodes toward the separator 26, a travelling electrical field may be applied to the electrodes in the manner described previously to cause one population of particles to be displaced across the array of electrodes to the left and the other population of particles to be displaced across the array of electrodes to the right or else to be unaffected. By this means, the outflow through the outlet 28 will be enriched with one population of particles and the outflow through the outlet 30 will be enriched with the other population. The track of a particular particle according to the first population of particles is shown by the arrow 32. The provision of numerous similar stages of the kind illustrated enables large volumes of liquid to be handled. The outflow from either of the two outlets 28 and 30 may be forwarded to the inlet of similar apparatus for further separation.

Figure 5:
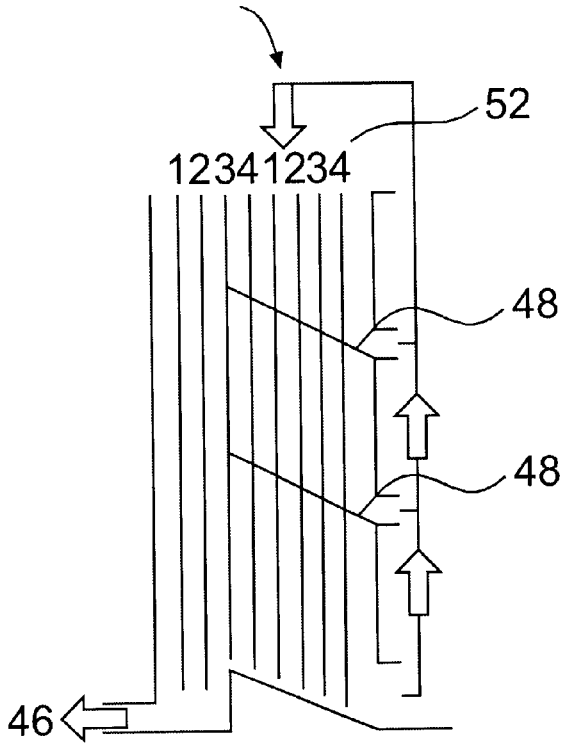
FIG. 5 shows the flow scheme and electrode layout of the apparatus of FIG. 4 in plan view.
Figure 4:
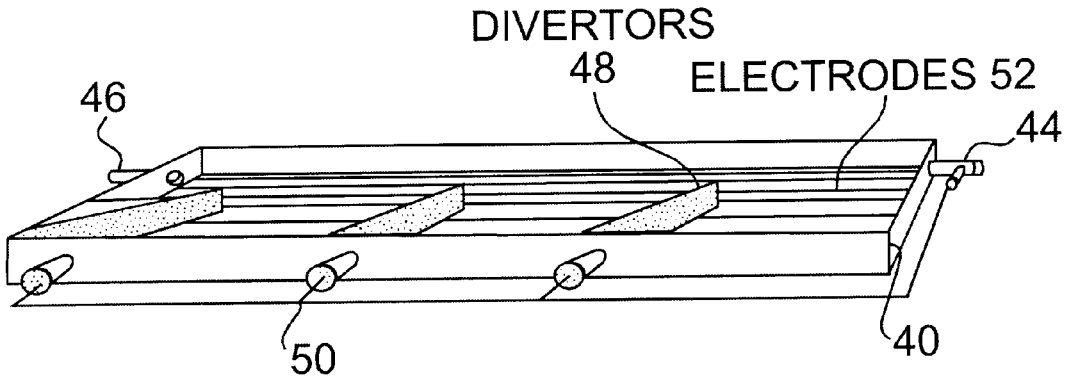
FIG. 4 shows in perspective view a third embodiment according to the invention in which multiple separation stages are arranged in series.
Figure 6:
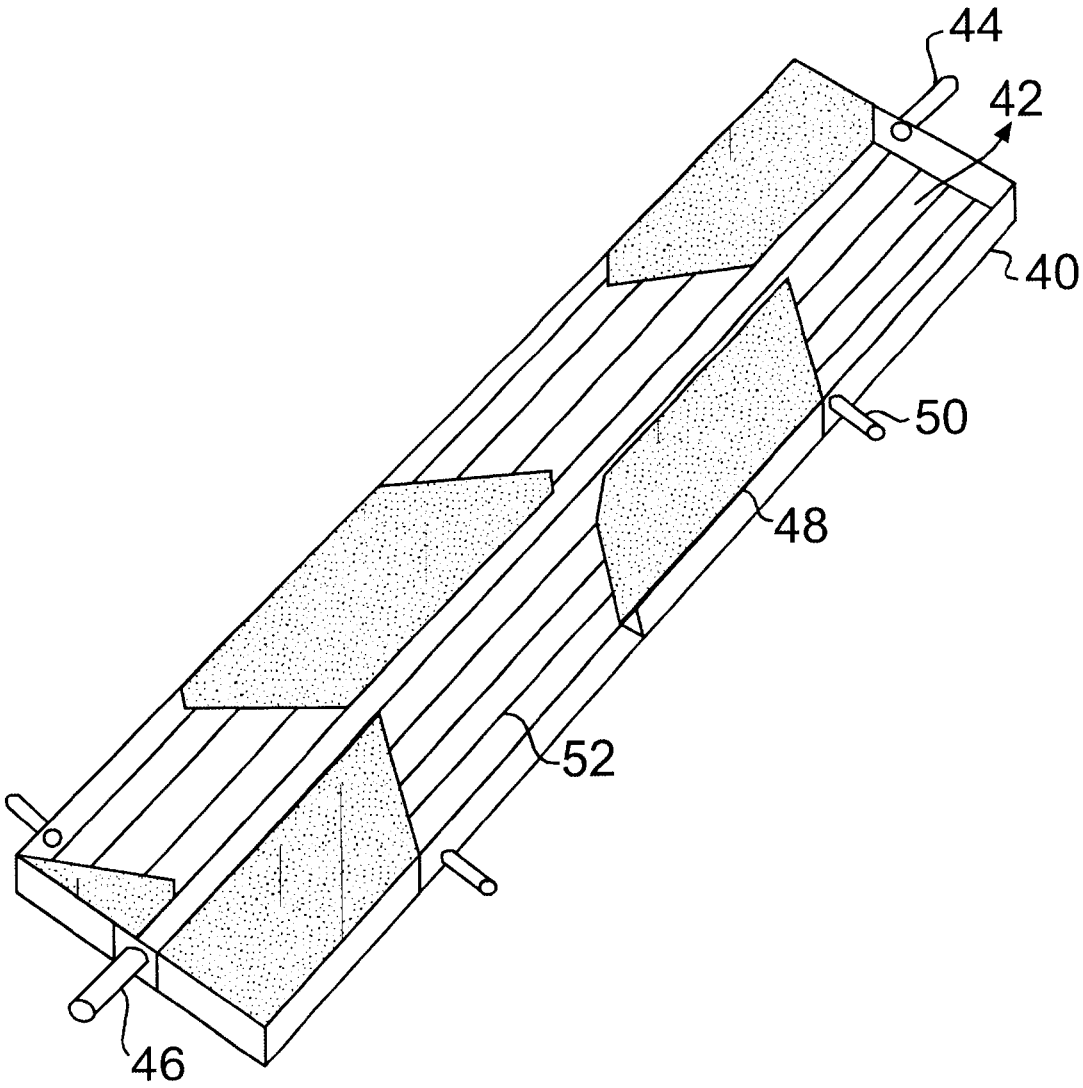
FIG. 6 shows a fourth embodiment according to the invention in which multiple separation stages are arranged in series.
Figure 7:
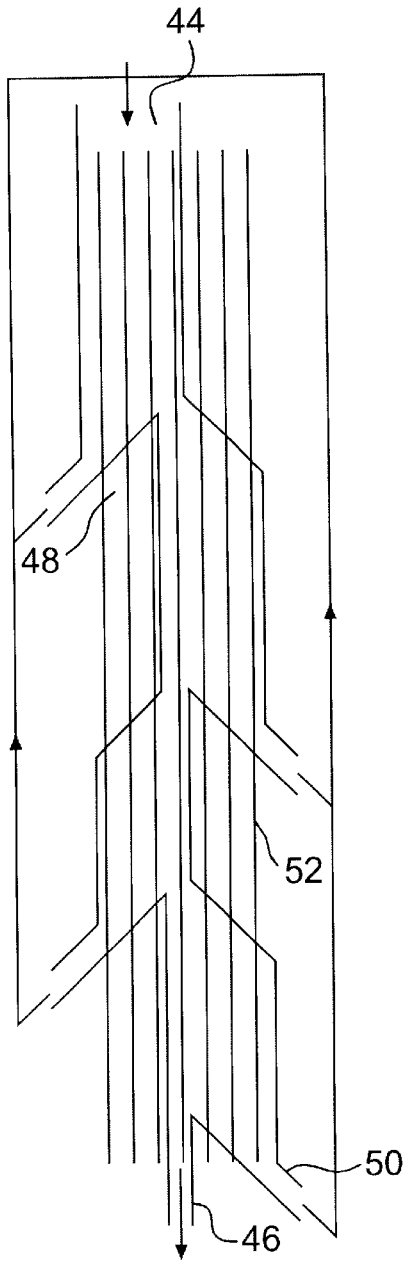
FIG. 7 shows the flow scheme and electrode layout of the apparatus of FIG. 6 in plan view.

The apparatus shown in FIGS. 4 and 5 and the apparatus shown in FIGS. 6 and 7 are essentially similar and may be described together. Each has a housing 40 defining a rectangular (in plan) cavity 42 into which there is an inlet 44 at one end of cavity 42 and an outlet 46 at the other end, such that the cavity forms a flow path between the inlet and outlet. Spaced along this flow path are a plurality of flow diverters 48 with each of which is associated an outlet 50 in the side wall of the housing. In the apparatus of FIG. 4, the inlet and outlet 44, 46 are to one side of the housing 40 and all the flow diverters 48 deflect flow to the opposite side, at which are located all the outlets 50. In the apparatus of FIG. 6, both the inlet 44 and the outlet 46 are on the centre line of the housing and alternate ones of the flow diverters are directed to opposite sides of the housing.

A ladder of electrodes 52 is provided each running the length of the housing 40, all parallel and equispaced. These are wired in the same way as described previously in four sets as shown in FIG. 5. More electrodes would normally be present than are shown.

A liquid containing particles to be concentrated or separated will be introduced via inlet 44 and will be Flowed through the apparatus by gravity or by the use of a pump.

A travelling wave field applied to the electrodes may be used to draw a first class of particles out of the main flow and to one side. In FIG. 6, two classes of particles may be drawn aside, one in one direction and the other in the opposite direction. These may be withdrawn via the outlets 50, and as shown in FIGS. 5 and 7 may be recycled back to the inlet. A third class of particles, unaffected by the field may be collected in increased concentration or purity from the outlet 46.

The flow through the apparatus may be continuous or may be intermittent, with pauses during which the particles are provided with time to migrate sideways under the influence of the field.

Figure 8:
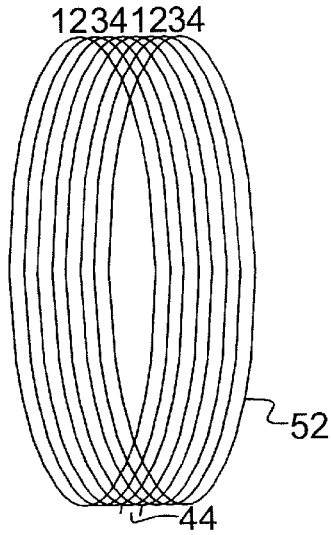
FIG. 8 shows in schematic perspective view a modified form applicable to the apparatus of FIG. 4 or FIG. 6.

In FIG. 8, there is shown an apparatus formed (conceptually) by curving the apparatus of FIG. 4 or of FIG. 6 into a closed circle out of the plane of the housing 40. An inlet/outlet 44 may be used to introduce a sample. By rolling the apparatus, gravity may be employed to provide a flow of sample parallel to the electrodes. Connection to the electrodes may be via a central rotating contact. The sample may make numerous passes around the apparatus before being withdrawn via the inlet/outlet 40 and the outlets 50 after particles within the sample have been segregated by the application of a travelling field.

Figure 9:
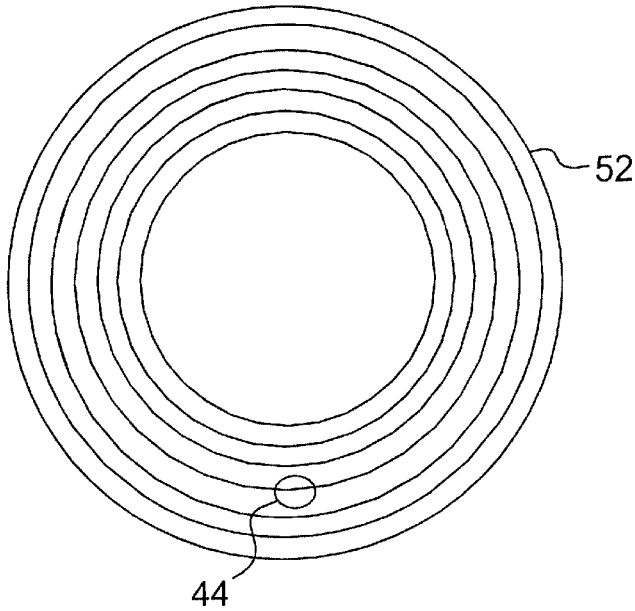
FIG. 9 shows in schematic plan view a further modified form applicable to the apparatus of FIG. 4 or that of FIG. 6.

Similarly, the apparatus shown in FIG. 9 may conceptionally be formed by curving the apparatus of FIG. 4 or of FIG. 6 around into a circle, this time in the plane of the housing 40. Once again the inlet 44 and the outlet 46 may be replaced by a combined inlet/outlet 44 or they may be arranged on opposite faces of the apparatus. A sample may be introduced and the apparatus may be tilted and precessed (e.g. by the use of an orbital shaker) to provide a gravity driven flow until the sample is withdrawn via the inlet/outlet 44 and the outlets 50, possibly after having made multiple circuits of the apparatus.

In each of the forms of the apparatus shown in FIGS. 4 to 9, the sample is subjected to multiple stages of separation in a series cascade so as to present partially purified material to the next stage each time and gradually to achieve increased separation. The flow from the lateral outlets 50 may be recycled to the inlet as shown in FIGS. 5 and 7 if desired.

Separate units of the kind shown in FIGS. 4 and 6 may be connected in series so allowing different electrical conditions to be applied in each to remove other particles from the through flow.

What is claimed is:

1. Apparatus for use in separating particles contained in a liquid, comprising a departure point and at least two destinations, means defining a path for liquid flow between said departure point and said destinations, an array of electrodes spaced from one another in a direction transverse to said path and each extending generally in the direction of said path, and means for applying a travelling electrical field to said electrode array to produce travelling wave field migration of selected particles in said liquid in said path in a direction transverse to said path such that said selected particles are preferentially directed to a respective one of said destinations, each of said destinations having an outlet.

2. Apparatus as claimed in claim 1, comprising multiple stages, each stage comprising said departure point and at least two said destinations, means defining a path for liquid flow between said departure point and said destinations, an array of said electrodes spaced from one another in a direction transverse to said path and each extending generally in the direction of said path, and means for applying said travelling electrical field to said electrode array to produce travelling wave field migration of selected particles in said liquid in said path in a direction transverse to said path such that said selected particles are preferentially directed to a respective one of said destinations, with said destination for the selected particles of each stage or the or an other of said destinations of each stage being connected for liquid flow to the departure point of the next said stage.

3. Apparatus as claimed in claim 1, comprising multiple stages arranged to operate in parallel, each stage comprising said departure point and at least two of said destinations, means defining said path for liquid flow between said departure point and said destinations in each stage, an array of said electrodes spaced from one another in a direction transverse to said path and each extending generally in the direction of said path, and means for applying said travelling electrical field to said electrode array to produce travelling wave field migration of selected particles in said liquid in said path in a direction transverse to said path such that said selected particles are preferentially directed to a respective one of said destinations of each stage.

4. Apparatus as claimed in claim 1, wherein said means defining a path is provided by means defining a flow path for liquid containing said particles in suspension.

5. A method of separation of particles contained in a liquid comprising passing a liquid containing a mixture of particles to be separated through a separator having a departure point for said liquid containing said particles to be separated and at least two destinations for liquid containing separated particles, in which the liquid containing the particles to be separated is caused to flow along a path from said departure point to each said destination such that a first portion of said fluid flows to a first said destination and an adjacent portion of said fluid flows to a second said destination and particles in said liquid are subjected to a travelling wave field producing particle movement transverse to said path and to said liquid flow so as to separate said particles from said first portion of the liquid into said adjacent portion of the liquid such that differing particle populations reach respective ones of said destinations, each of said destinations having an outlet.

6. A method as claimed in claim 5, wherein said separator comprises multiple separation stages operating in parallel, each stage having said departure point for liquid containing particles to be separated and at least two said destinations for liquid containing separated particles, in each of which stages the liquid containing the particles is caused to move along said path from said departure point to said destinations and said particles are subjected to said travelling wave field producing particle movement transverse to said path so as to separate said particles such that differing particle populations reach respective ones of said destinations.

7. A method as claimed in claim 5, comprising passing said liquid containing a mixture of particles to be separated through said separator providing multiple separation stages in series, each stage having said departure point for liquid containing particles to be separated and at least two destinations for liquid containing separated particles, in each of which stages the liquid is flowed along said path from said departure point to said destinations and said particles are subjected to said travelling wave field producing particle movement transverse to said path to separate said particles such that differing particle populations reach respective ones of said destinations, with particles of a selected population being fed from the respective destination of each stage to the departure point of the next stage.

8. A method as claimed in claim 5, wherein said particles are microparticles.

9. A method as claimed in claim 8, wherein the particles of a selected population are recycled to the or a departure point of the separator.

10. A method as claimed in claim 5, wherein movement of said particles from said departure point to said destination along said path is produced by a flow along said path of liquid in which said particles are suspended.

* * * * *